United States Patent [19]

Wilkes

[11] Patent Number: 4,821,046

[45] Date of Patent: Apr. 11, 1989

[54] DUAL BAND FEED SYSTEM

[76] Inventor: Brian J. Wilkes, P.O. Box 395, Leesburg, Fla. 32748

[21] Appl. No.: 34,710

[22] Filed: Apr. 6, 1987

Related U.S. Application Data

[63] Continuation-in-part of Ser. No. 898,486, Aug. 21, 1986.

[51] Int. Cl.[4] ..... H01Q 13/00

[52] U.S. Cl. ..... 343/786; 343/772; 343/776; 333/21 A

[58] Field of Search ..... 343/786, 772, 773, 776; 333/214, 135, 126, 129, 137, 132

[56] References Cited

U.S. PATENT DOCUMENTS

| | | | |
|---|---|---|---|
| 2,628,278 | 2/1953 | Zaleski | 333/21 A |
| 2,735,093 | 1/1952 | Krausz et al. | 343/791 |
| 3,296,558 | 1/1967 | Bleackley | 333/21 A |
| 3,324,423 | 6/1967 | Webb | 343/786 |
| 3,325,817 | 6/1967. | Atioka et al. | 343/786 |
| 3,369,197 | 2/1968 | Giger et al. | 343/786 |
| 3,508,277 | 4/1967 | Ware et al. | 343/786 |
| 3,566,309 | 2/1971 | Atioka | 343/786 |
| 3,665,481 | 5/1972 | Low et al. | 343/762 |
| 3,864,687 | 2/1975 | Walters et al. | 343/786 |
| 3,924,205 | 12/1975 | Hansen et al. | 333/21 A |
| 4,041,499 | 8/1977 | Liv et al. | 343/786 |
| 4,207,573 | 6/1980 | Viguier | 343/727 |
| 4,414,516 | 11/1983 | Howard | 333/21 A |
| 4,442,437 | 4/1984 | Chu et al. | 343/786 |
| 4,498,062 | 2/1985 | Massaglia et al. | 343/756 |
| 4,503,379 | 3/1985 | Raiman | 333/21 A |

FOREIGN PATENT DOCUMENTS

| | | | |
|---|---|---|---|
| 0001902 | 1/1985 | Japan | 333/135 |

OTHER PUBLICATIONS

"Antenna Engineering Handbook", 2d Ed. Johnson & Jasik, McGraw-Hill Book Co., pp. 42-30.

"Andrew Antenna Systems"—Circular Waveguide.

*Primary Examiner*—William L. Sikes

*Assistant Examiner*—Hoanganh Le

*Attorney, Agent, or Firm*—Macdonald J. Wiggins

[57] ABSTRACT

A dual frequency band microwave antenna feed for a parabolic reflector has a circular waveguide for a low frequency band and a smaller circular waveguide for a higher frequency band disposed in and concentric with the low band guide. A twisted conductive baffle is disposed in each guide to permit 90° rotation of linearly cross-polarization signals and a pair of in-line ports is attached to each guide for output of such pairs of cross-polarization signals.

11 Claims, 2 Drawing Sheets

DUAL BAND FEED SYSTEM

This application is a continuation-in-part of Ser. No. 898,486 entitled "Concentric Waveguides for a Dual-Band Feed System" filed Aug. 21, 1986.

BACKGROUND OF THE INVENTION

1. Field of the Invention

The present invention relates to microwave antenna feed systems, and more particularly to a dual frequency band feed system for a parabolic antenna or the like.

2. Description of the Prior Art

The use of geostationary satellites for providing communications for video, data, and audio circuits has become widespread. Presently, two frequency bands are being used; the C-band which covers 3.7–4.2 GHz and the Ku band in the frequency range from 9–15 GHz. With the prevalence of receive only television ground stations, high efficiency feed systems have been developed. As the higher frequency Ku band becomes more widely used, many ground stations presently operating in the lower frequency C-band will require antennas to receive the higher frequency signals. The most economical approach is to utilize the same parabolic reflector. If one feed system is placed on the boresight of the antenna, it would be necessary for the feed system for the other band to be displaced a number of beamwidths from the boresight. While such arrangement could produce maximum efficiency on one band, the efficiency on the other band would be reduced. Thus, there is a need for a feed system which allows both high band and low band feeds to be at the boresight of a parabolic reflector to maintain maximum efficiency for each band.

While dual and multiple feeds are known in the prior art, none are suitable for the present application. The following U.S. Pat. Nos. disclose various types of multi-frequency feeds: 3,665,481 Lowe et al; 3,369,197 Giger et al; 3,864,687 Walters et al; 4,345,257 Brunner; 4,420,756 Amata et al; and 4,442,437 Chu et al.

Lowe et al disclose a plural coaxial horn feed for use on a spacecraft which transmits at two frequencies and receives tracking signals at a third frequency. A conical horn is used on the high frequency feed which blocks a portion of the lower band feed as well as degrading the VSWR. The feed is designed for circular polarization and utilizes the $TE_{11}$ and $TM_{01}$ modes. For use with the geostationary satellites, dual linear polarization is required. Giger et al teach a waveguide with separate coaxial cavities with selective mode separation within the same frequency band. Several modes are fed. Various diameter guides are utilized and are coupled together in sequence. In Amata et al, a multimode tracking antenna feed system is described in which the low frequency feed utilizes the $TE_{11}$ mode and the high frequency feed utilizes the $TM_{01}$ and $TE_{11}$ modes. Chu et al disclose a dual mode feedhorn which allows the propagation of $TE_{11}$ modes in both the high and low frequency bands. Walters et al teach a wide band multimode antenna which has a plurality of coaxial, independently fed radiating horns.

SUMMARY OF THE INVENTION

The present invention provides a compact, dual frequency band feedhorn for transmission and reception of linear cross-polarized signals on each band. The vertically polarized and horizontally polarized signals of each band can be transmitted or received independently of each other. Although the invention can be applied to almost any set of low and high frequency bands, the invention will be described with reference to the C-band from 3.7–4.2 GHz and the Ku band from 9.0–15.0 GHz.

A first circular waveguide is provided for the lower frequency C-band having a diameter which will support the $TE_{01}$ mode and a smaller circular Ku band waveguide is disposed concentrically with the C-band waveguide. The C-band waveguide diameter is large enough to support the $TE_{01}$ mode and small enough to propagate signals throughout the complete band without reaching the cutoff frequency of the waveguide. The diameter of the Ku band waveguide is selected to transmit the entire band and is disposed within the null area of the $TE_{01}$ mode in the C-band waveguide. Thus, the Ku band waveguide does not degrade or reflect transmissions in the lower frequency waveguide by reflection or blockage.

It may also be recognized that the Ku band waveguide acts as a mode filter for all other modes at the C-band frequencies and therefore only the $TE_{01}$ mode will be supported.

Two in-line ports are provided in each waveguide for linearly polarized signal outputs. Necessarily, the Ku band waveguide will extend sufficiently from the rear end of the C-band waveguide to permit provision of the output ports. Similarly, the C-band waveguide includes a pair of in-line ports for the linear signal input or output. To permit the in-line configuration of the output ports, a 90 degree polarization rotator for one signal is required. The rotator may be a twisted conducting baffle which rotates the planes of the linearly polarized signal 90 degrees. A system of this type is taught in U.S. Pat. No. 3,924,205 to Hansen et al.

While it is convenient to have the ports in-line, it will be noted that the ports may be displaced 90 degrees from each other, in which case the polarization rotator is not required. However, a vane or ferrite type polarization adjustment may be required to be able to accurately align the linearly polarized signals with the output ports for received signals. A typical device for this purpose is described in U.S. Pat. No. 3,924,205 to Hansen et al.

Typically, a scalar feed network may be mounted concentrically with the C-band waveguide and the aperture illumination adjusted in accordance with the focal-to-diameter ratio of the parabolic antenna for C-band signals. To adjust the aperture illumination for the focal-to-diameter ratio of the Ku band feed, the distance that the inner circular waveguide protrudes from the plane of the outer end of the C-band waveguide may be varied.

Thus, a simple, compact and low cost dual frequency feedhorn has been provided which may be used with linear, cross-polarized signals in each of two widely separated frequency bands with minimum interaction between the two feeds to provide a high efficiency antenna with a single parabolic reflector.

It is therefore a principal object of the invention to provide a compact, low cost, high efficiency feedhorn which will support signals in different frequency bands and may be used to illuminate a single parabolic reflector.

It is another object of the invention to provide a set of coaxial circular waveguides in which the inner waveguide will support the $TE_{01}$ mode in a high frequency band and the outer circular waveguide will support the $TE_{01}$ mode in a lower frequency band in which the smaller diameter waveguide will act as a mode suppressor for other modes in the outer circular waveguide.

It is still another object of the invention to provide a dual frequency band feedhorn for parabolic antenna systems utilized with geostationary satellites in which each feed can be independently adjusted for maximum illumination efficiency.

It is yet another object of the invention to provide a dual frequency feedhorn for linear, cross-polarized signals having inline ports for each separate linearly polarized signal.

These and other objects and advantages of the invention will become apparent from the following detailed description when read in conjunction with the drawings.

DETAILED DESCRIPTION OF THE PREFERRED EMBODIMENT

Figure 1:
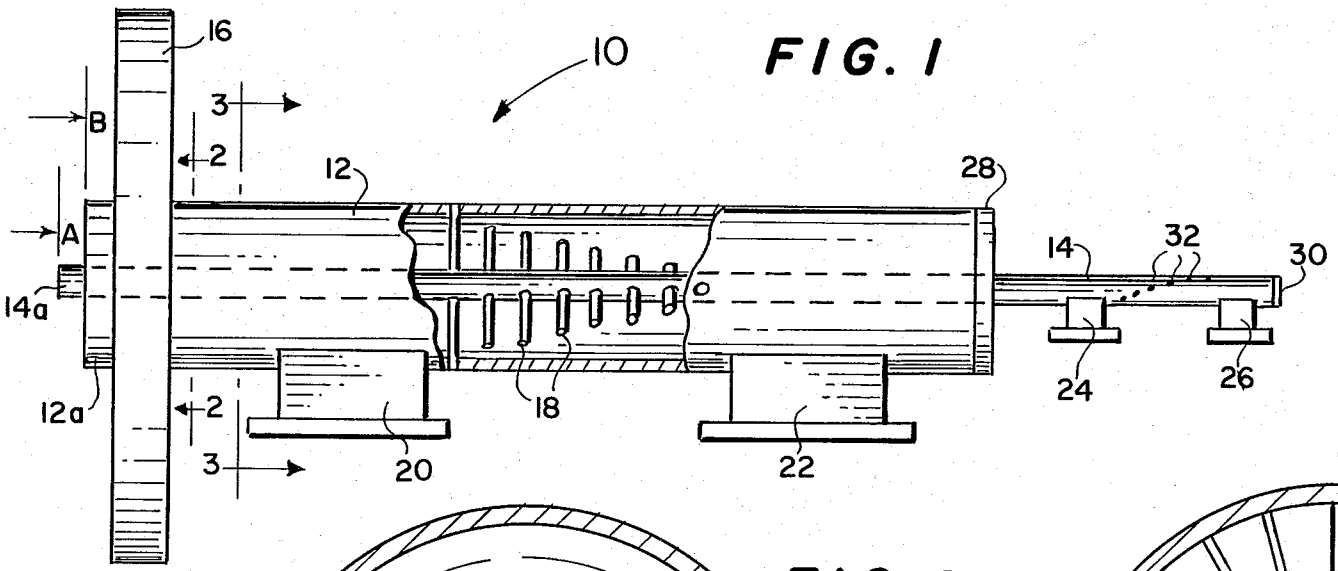
FIG. 1 is a plan view of a dual frequency band feedhorn in accordance with the invention having a portion of the low frequency waveguide partially cut away to show polarization rotation means to permit in-line ports.

Referring to FIG. 1, a plan view of a dual frequency band feedhorn is shown. The embodiment of FIG. 1 will be described with reference to a feedhorn for the C-band and the Ku band for use with parabolic reflectors and geostationary communications satellites. It is to be understood, however, that the invention is suitable for any pair of frequency bands for which waveguides may be selected to meet the criteria described in more detail hereinbelow. A length of circular waveguide 12 is provided having a closed end 28 and an open end 12A to form a horn for receiving or transmitting C-band signals. A second circular waveguide 14 of a smaller outside diameter than the inside diameter of waveguide 12 is selected, which has a closed end 30 and an open end 14A to form a horn for receiving or transmitting Ku band signals.

The diameter of circular waveguide 12 and circular waveguide 14 are selected in accordance with the following criteria. Circular waveguide 14 has an inside diameter great enough to allow energy to be transmitted and received over the entire Ku band without reaching its waveguide cutoff frequency. Circular waveguide 12 is selected to have a large enough diameter to place the outside diameter of the smaller circular waveguide 14, when disposed concentric with waveguide 12, to be within the null area of the $TE_{01}$ mode in waveguide 12. The diameter of waveguide 14 must be small enough to be contained within the $TE_{01}$ mode null so as not to degrade C-band transmission in the larger waveguide by reflection or blockage. The diameter of waveguide 12 must also be small enough to contain the complete C-band frequency range without reaching that waveguide cutoff frequency.

Circular waveguide 12 is provided with a scalar feed network 16 which may be used to control the aperture illumination of the C-band waveguide horn 12A by varying the distance B by which forward end 12A of waveguide 12 protrudes from the scalar network 16. This permits matching the feedhorn to the focal-to-diameter ratio of the parabolic reflector with which the feedhorn is used.

Similarly, the aperture illumination for Ku band is controlled by varying distance A by which the forward end 14A of the Ku band waveguide 14 protrudes from the C-band portion 12A. This arrangement advantageously permits independent control of aperture illumination of the two horns to match the specific parabolic reflector.

Figure 2:
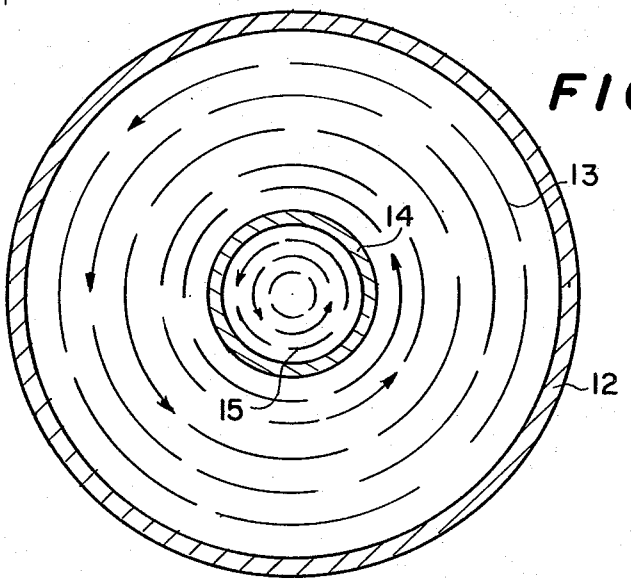
FIG. 2 is a cross-sectional view of the waveguide portions of FIG. 1 in the plane 2—2.

FIG. 2 shows a cross-section through the plane 2—2 of waveguides 12 and 14. The electric field produced between inner waveguide 14 and outer waveguide 12 is in the $TE_{01}$ mode as indicated at 13. Similarly, the electric field within waveguide 14 is also in the $TE_{01}$ mode as indicated at 15. As previously mentioned, the conductive outer surface of waveguide 14 lies within the null area of $TE_{01}$ mode 13 and therefore no current will flow on that surface, minimizing any losses. Inner waveguide 14 also acts as a mode suppressor to suppress all but the dominant mode in waveguide 12.

A primary application of the dual frequency feed of the invention is for communication signals in which linearly polarized signals are transmitted in cross-polarization. Therefore, each waveguide requires two output ports, one for each direction of linear polarization. As will be noted from FIG. 1, a pair of in-line ports 20 and 22 is provided for waveguide 12. A second pair of in-line ports 24 and 26 is provided for waveguide 14. These ports may be rectangular waveguide sections with appropriate flanges for connecting thereto. The in-line configuration permits feed lines which will produce minimum blocking of the associated reflector.

Figure 3:
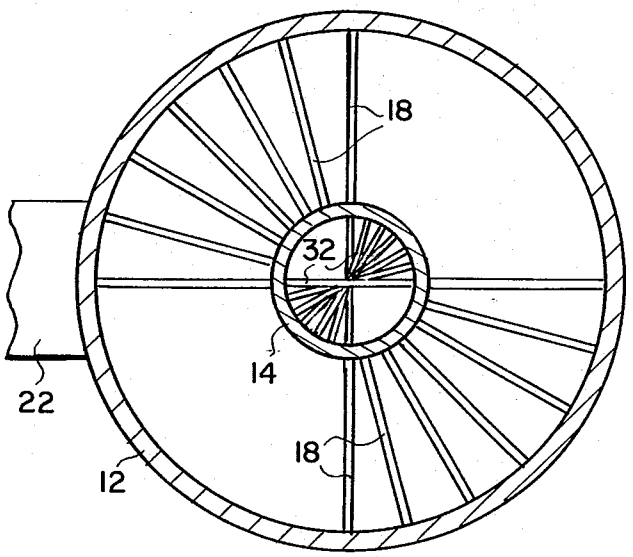
FIG. 3 is a cross-sectional view of the circular waveguide portions of FIG. 1 through the plane 3—3 showing the cross-polarization rotation structures.

With the in-line arrangement of the ports, a 90 degree polarization rotation must be applied to one of the cross-polarized incoming or outgoing signals. In the embodiment of FIG. 1, and as shown in more detail in the cross-sectional view through plane 3—3 of FIG. 3, a conductive twisted baffle is shown which extends diametrically across the inner surface of waveguide 12 utilizing conductive pins 18 as elements of such baffle. Similarly, pins 32 in waveguide 14 provide a conductive twisted baffle for the Ku signals. Additional details of this technique may be found in the Hansen et al patent previously referred to. Thus, a received cross-polarized signal, for example, in waveguide 12 will have one component appear at port 20 while the orthogonal component will be rotated 90 degrees and will appear at port 22. The opposite action will take place with transmitted signals where the two signals having the same polarization applied to ports 20 and 22 will experience 90 degree rotation of the port 22 input signal such that cross-polarized signals will be radiated from horn 12A.

Although the in-line configuration of the ports is preferred, the polarization rotators may be eliminated by providing two ports separated by 90 degrees for each waveguide. This arrangement is shown in FIG. 4 in which C-band waveguide 32 has two ports 38 and 40 disposed at 90 degrees from each other while Ku waveguide 34 includes ports 42 and 46 also at right angles to each other.

Figure 4:
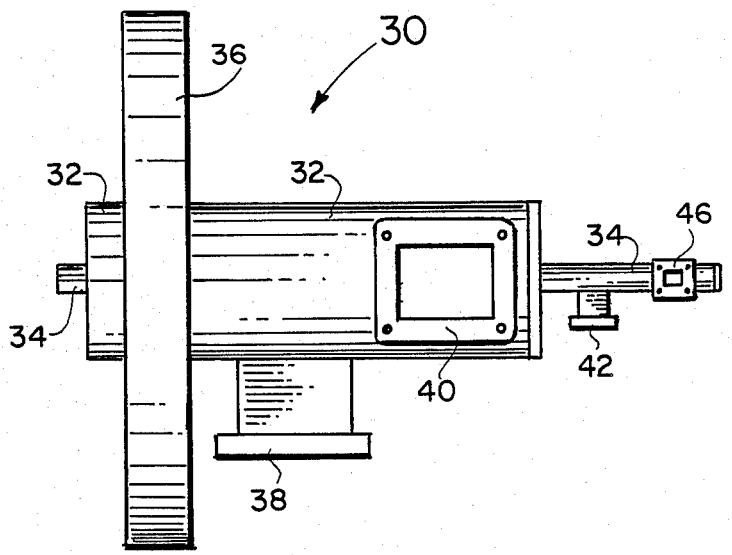
FIG. 4 is an embodiment of the invention having orthogonal ports.

Although not shown, the embodiments of the invention shown in FIG. 1 and FIG. 4 may include a mechanically adjustable vane or an electrically controllable ferrite device in the respective waveguides to trim the polarization of the incoming signal when receiving to ensure that the cross-polarized signals are aligned with the output ports.

Although the invention has been described for exemplary purposes using a C-band and Ku band system, it will be obvious that other pairs of frequency bands may be used as long as the criteria for selecting of diameters of the two circular waveguides are met. Modifications to the disclosed mechanical construction of the exemplary embodiment will be obvious to those of skill in the art and such variations are considered to fall within the spirit and scope of the invention.

I claim:

1. A dual frequency band microwave antenna feed for a parabolic reflector comprising:

a first circular waveguide having a diameter for supporting first electromagnetic waves of a first microwave frequency range in the $TE_{01}$ mode;

a second circular waveguide disposed concentrically with said first circular waveguide for supporting second electromagnetic waves of a second microwave frequency range, higher in frequency than the first microwave frequency range, in the $TE_{01}$ mode, a rearward portion of said second circular waveguide extending from a rearward end of said first waveguide;

a first one of a first pair of in-line ports disposed in said first circular waveguide for output of a first one of a first pair of linearly cross-polarized electromagnetic waves;

first polarization rotation means for rotating the planes of said first linearly cross-polarized electromagnetic waves rearward of said first port in said first waveguide;

a first one of a second pair of in-line ports disposed in said second waveguide for output of a first one of a second pair of linearly cross-polarized electromagnetic waves; and second polarization rotation means for rotating the planes of said second linearly cross-polarized electromagnetic waves rearward of said first port in said second waveguide.

2. The antenna feed as recited in claim 1 in which:

said first polarization rotation means includes a first twisted conductive baffle between said first pair of in-line ports; and said second polarization rotation means includes a second twisted conductive baffle between said second pair of in-line ports.

3. The antenna feed as recited in claim 1 which further includes a circular scalar feed network disposed concentrically with and at a forward end of said first circular waveguide.

4. The antenna feed as recited in claim 3 in which said first circular waveguide protrudes from said scalar feed network.

5. The antenna feed as recited in claim 4 in which the protrusion of said first circular waveguide from said scalar feed network is controllable for adjusting the aperture illumination of said antenna feed for said parabolic reflector for said first microwave frequency range.

6. The antenna feed as recited in claim 1 in which a forward portion of said second circular waveguide protrudes from a forward end of said first circular waveguide.

7. The antenna feed as recited in claim 6 in which the protrusion of said second circular waveguide from the forward end of said first waveguide is controllable for adjusting the aperture illumination of said antenna feed for said parabolic reflector for said second microwave frequency range.

8. The antenna feed as recited in claim 1 in which the outside diameter of said second circular waveguide is selected to coincide with a null area of the $TE_{01}$ mode in said first circular waveguide.

9. The antenna feed as recited in claim 8 in which the inside diameter of said second circular waveguide is selected to support the $TE_{01}$ mode for said second frequency range.

10. The antenna feed as recited in claim 1 in which said first frequency range is between at least 3.7 to 4.2 GHz.

11. The antenna feed as recited in claim 10 in which said second frequency range is between at least 9.0 to 15.0 GHz.

* * * * *